US006992258B2

(12) United States Patent
Vieira

(10) Patent No.: US 6,992,258 B2
(45) Date of Patent: Jan. 31, 2006

(54) SWITCHING DEVICE FOR GAS OPERATED APPLIANCE

(76) Inventor: Manuel Vieira, 94 Snowood Court, Toronto, Ontario (CA) M3N 1E8

( * ) Notice: Subject to any disclaimer, the term of this patent is extended or adjusted under 35 U.S.C. 154(b) by 0 days.

(21) Appl. No.: 10/884,206

(22) Filed: Jul. 2, 2004

(65) Prior Publication Data

US 2005/0023115 A1 Feb. 3, 2005

(51) Int. Cl.
*H01H 9/06* (2006.01)
*H01H 43/10* (2006.01)

(52) U.S. Cl. ..... 200/61.86; 200/38 R; 200/38 FA; 431/256; 431/264; 431/266

(58) Field of Classification Search . 200/38 R–38 DA, 200/61.85, 61.86, 330, 331; 431/256, 264, 431/266
See application file for complete search history.

(56) References Cited

U.S. PATENT DOCUMENTS 3,358,121 A * 12/1967 Bowling ..... 219/412
4,756,336 A * 7/1988 Amezcua ..... 137/624.12
4,783,600 A * 11/1988 Chang ..... 307/116
5,464,953 A 11/1995 Kim
5,813,320 A 9/1998 Frasnetti et al.
5,927,598 A 7/1999 Broe
6,041,768 A 3/2000 Giammona et al.
6,354,172 B1 * 3/2002 Piacenza et al. ..... 74/568 T
6,755,213 B1 * 6/2004 Lai ..... 137/624.11
2003/0154970 A1 * 8/2003 Huang ..... 126/39 R
2005/0063132 A1 * 3/2005 Chen et al. ..... 361/247

* cited by examiner

*Primary Examiner*—Michael A. Friedhofer
(74) *Attorney, Agent, or Firm*—Young & Basile, P.C.

(57) ABSTRACT

A combination timer and controller for a gas-operated appliance, such as a pizza oven, is provided. The combination includes a rotatable control shaft having a first end connectible to a gas valve and a control knob attachable to a second end of the control shaft. A timer can be preset to a selected time at which the control shaft is to be turned from an off position to an on position. An actuator motor is provided to turn the control shaft to the on position and it is controlled by the timer so that the motor is turned on by the timer at the selected time. There is a gear arrangement for connecting the output of the motor to the control shaft and a coil spring for rotating the control shaft to the off position when the motor is turned off.

20 Claims, 3 Drawing Sheets

SWITCHING DEVICE FOR GAS OPERATED APPLIANCE

BACKGROUND OF THE INVENTION

This invention relates to control apparatus for a device, such as an appliance, having a control knob rotatable between an "OFF" and an "ON" position.

It is commonly known to control an appliance such as an oven by means of one or more manually operated controls, including control knobs that can be rotated between "OFF" and "ON" positions. Stoves and ovens that employ natural gas as a heating fuel are commonly used both at home and commercially. One such form of oven that can employ gas as a fuel is a pizza oven and, in particular, such ovens that are large enough and suitable for commercial operators and commercial outlets for pizzas.

A known difficulty that is commonly encountered by the operators of pizza ovens, particularly those at commercial establishments, is that such ovens can require a significant amount of time to heat up to the required temperature. Accordingly, if the oven must be turned on manually by its operator, it is often necessary for the operator to attend at the commercial premises where the oven is located early, that is prior to the establishment opening for business, in order to turn the oven on so that it will reach the required temperature for pizza making when this becomes necessary. This can be a substantial inconvenience to and expense for the operator of the pizza oven. Other types of ovens may also need to be turned on by their operators at a time well in advance of the time at which they will actually be used for cooking or baking.

Although timing devices are common in home baking devices such as ovens, microwave ovens or slow cooking pots, the use of timing devices to turn on large commercial ovens such as pizza ovens is not common at the present time. However, one known timing apparatus for a commercial pizza oven is taught in U.S. Pat. No. 5,464,953 issued Nov. 7, 1995. This U.S. patent teaches a device capable of turning on a pizza oven that has a timer, a solenoid, a toggle switch and a special adaptor plate for mounting next to the control knob which operates the gas valve of the oven. The control knob is spring biased in a rotational direction toward the "ON" position of the knob. The timer is provided to energize the solenoid at a preset time duration, with the solenoid rod being coupled to a pivotable actuating arm, the free end of which is positioned for engagement with a detent formed in the adaptor plate. The toggle switch is in an electrical circuit with the timer and the toggle is physically positioned to be operated by a member projecting from the actuating arm.

More recent U.S. Pat. No. 6,041,768 issued Mar. 28, 2000, describes an oven with an electrical timer for saving and controlling gas. The clock timer is electrically connected to an on/off pilot and gas valve for automatically turning on or off the gas flow to the oven burner. The pilot and gas valve is a known form of electromechanical valve such as that sold by the White-Rodgers Division of Emerson Electric Co.

It is an object of the present invention to provide a reliable control apparatus having a timer which can be used to control a device such as an appliance having a control knob rotatable between an "OFF" and an "ON" position. This apparatus is able to turn on the device or appliance at a selected time and in a reliable manner.

It is another object of the invention to provide a novel control apparatus for a device such as an appliance having a control knob, which can be made at a reasonable cost and using known, readily available components and parts.

SUMMARY OF THE INVENTION

According to one aspect of the invention, a control apparatus for a device having a control knob rotatable between an "OFF" and an "ON" position includes a timer that can be preset to a selected time at which the control knob is to be turned from the "OFF" position to the "ON" position. The apparatus further includes an actuator motor for turning the control knob to the "ON" position, the operation of this motor being controlled by the timer whereby the motor is turned on by the timer at the selected time during use of the control apparatus. The motor has a rotatable output shaft and also means for mounting the motor at a suitable location for turning the control knob. There are also means for operatively connecting the output shaft of the motor to the control knob so that the control knob is turned to the "ON" position when the motor is turned on. The control apparatus also has a mechanism for automatically returning the control knob to the "OFF" position when the motor is turned off.

Preferably, the mechanism for automatically returning the control knob is a spring attached to the connecting means and, in a particularly preferred embodiment, this spring is a coil spring that extends around a shaft on which the control knob is mounted.

According to another aspect of the invention, a combination timer and controller for a gas operated appliance includes a rotatable control shaft having a first end connectable to a gas valve of the appliance in order to operate same and a control knob attachable to a second end of the control shaft located opposite the first end. The combination also has a timer that can be preset to a selected time at which the control shaft is to be turned from a first position corresponding to an "OFF" position of the control knob during use thereof to a second position corresponding to an "ON" position of the control knob during use thereof. An actuator motor is provided to turn the control shaft to the second position and the operation of this motor is controlled by the timer so that the motor is turned on by the timer at the selected time when the timer is used. The combination further includes means for mounting the motor at a suitable location for turning the control shaft and a mechanism for operatively connecting the motor to the control shaft so that the motor is capable of rotating the control shaft to the second position. There is also a mechanism for rotating the control shaft to the first position and the control knob to the "OFF" position when the motor is turned off.

The preferred rotating mechanism comprises a coil spring and the connecting mechanism between the motor and the control shaft includes a driven gear fixedly mounted on the control shaft with one end of the coil spring being attached to this driven gear.

According to another aspect of the invention, a combination timer and controller for operating a valve of an appliance includes a manually rotatable control device including a control knob and a control shaft connected to the knob, this control shaft being connectable to the valve for operation of the latter. There is also provided a timer for timing the operation of the valve and an electric actuator motor for rotating the control device from an "OFF" position to an "ON" position. The motor in use is controlled by the timer which is operatively connected thereto. The motor is turned on by the timer at a selected time during use of the combination. The combination also includes means for mounting the motor in a suitable position for operation and a mechanism for operatively connecting the motor to the control device so that the control device is rotated to the "ON" position when the motor is turned on and operates. A spring mechanism returns the control device to the "OFF" position when the motor is turned off.

The preferred combination includes an electrical control circuit operatively connected to the timer and the actuator motor. This circuit includes an electrical switch for manually controlling operation of the control circuit.

Further features and advantages will become apparent from the following detailed description taken in conjunction with the accompanying drawings.

DETAILED DESCRIPTION OF DRAWINGS

DETAILED DESCRIPTION OF PREFERRED EMBODIMENT

Figure 1:
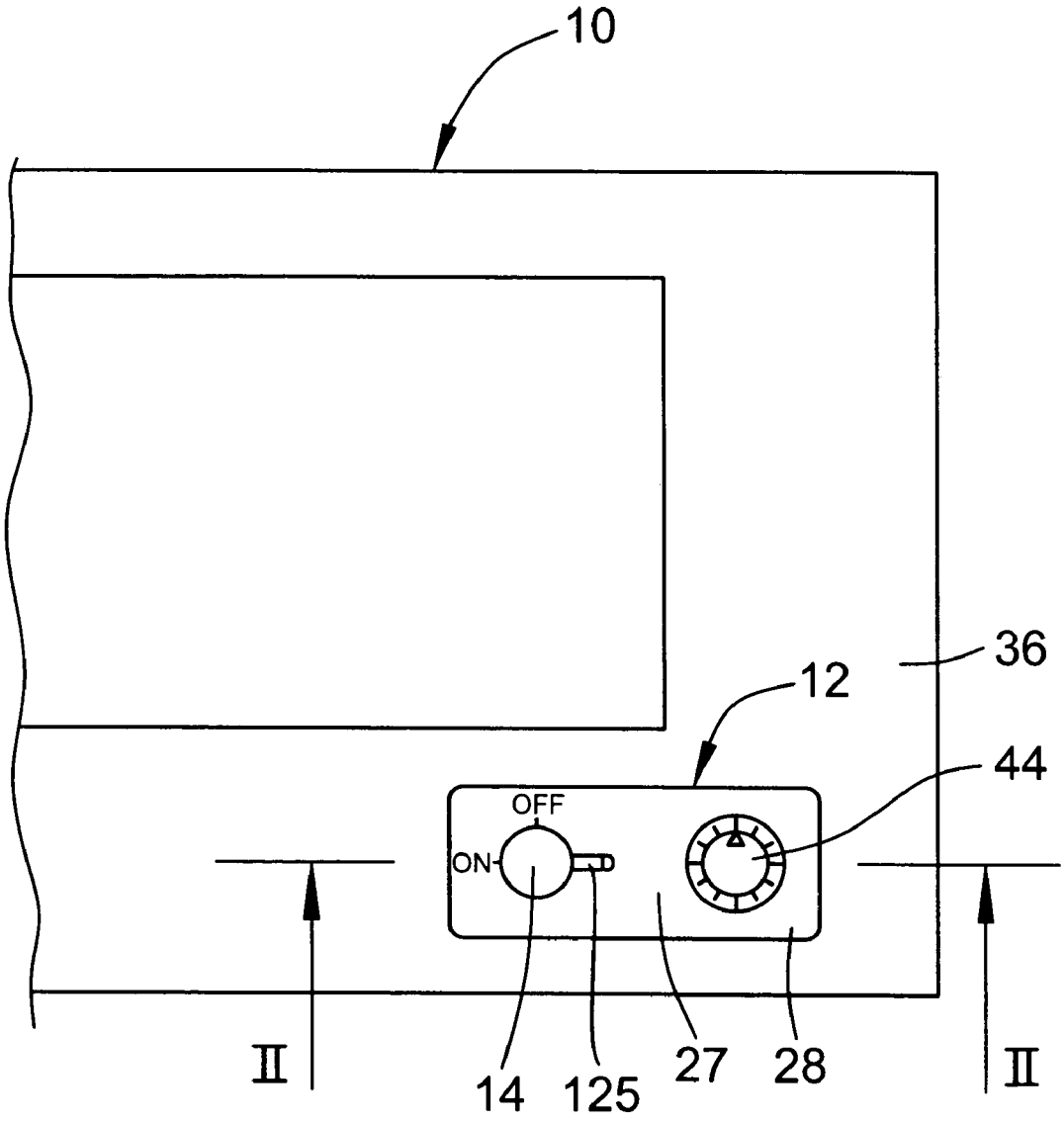
FIG. 1 is a partial front view of a gas-heated oven equipped with the control apparatus of the invention.

FIG. 1 shows a right side portion of an oven 10 such as a pizza oven. Except for the control apparatus of the invention which is indicated generally at 12, the oven 10 can be of standard construction and, accordingly, a detailed description herein is deemed unnecessary. A control knob 14 can be used to manually turn OFF or turn ON the flow of gas fuel to the oven. The control knob 14 is rotatable between an "OFF" and an "ON" position. The control knob 14 is mounted on an outer end of a rotatable control shaft 16 having an inner end connectible to a standard gas valve 18 for the oven in order to operate same. It will be appreciated that although the present invention is described in the context of an oven, the control apparatus of the invention can be used in other appliances for which there may be a desire to turn on the appliance at a preselected time using a timer. The gas controlled by the valve 18 can be natural gas or propane or another type of gas suitable for heating an oven.

Figure 2:
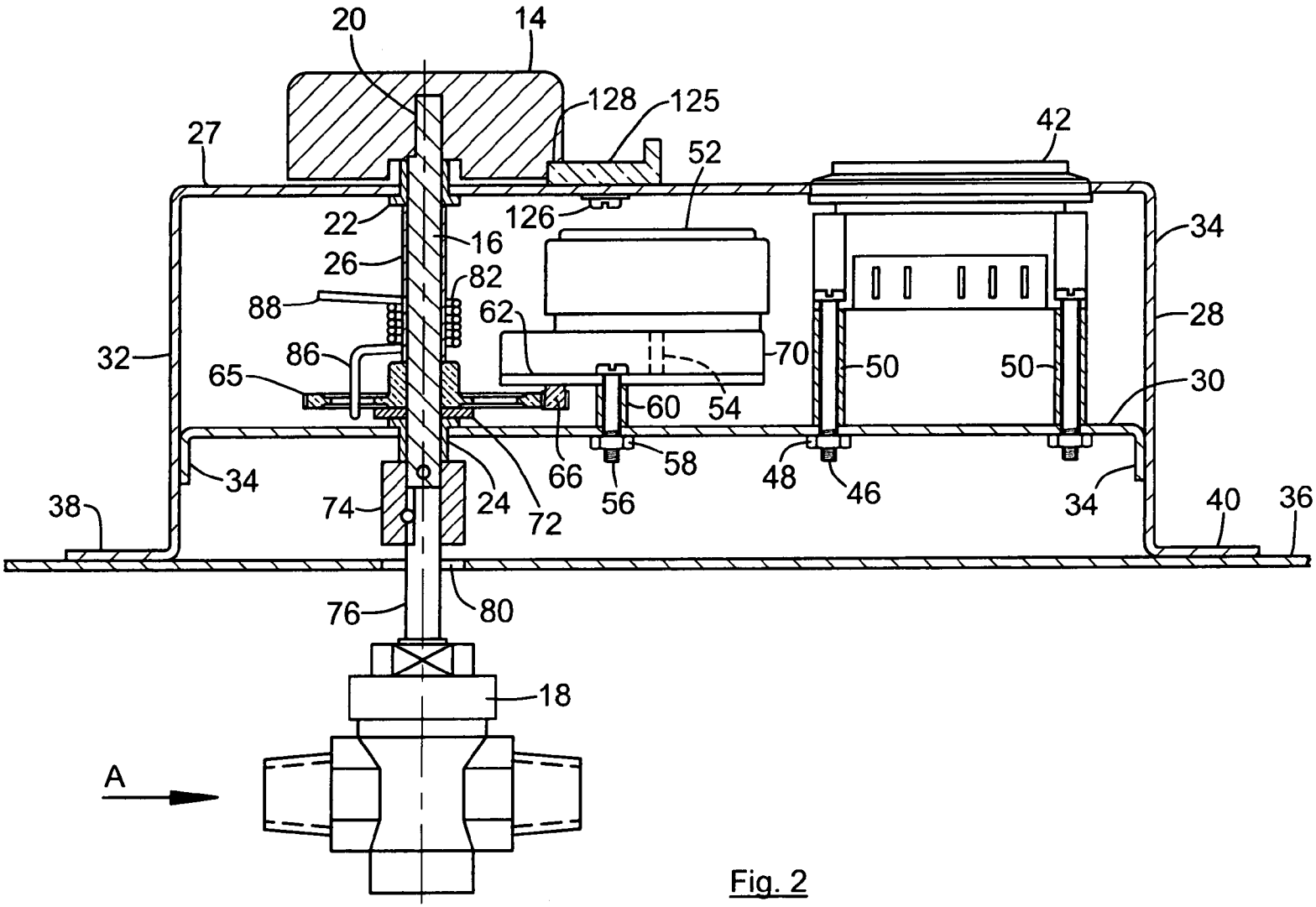
FIG. 2 is a cross-sectional view taken along the line II—II of FIG. 1 showing the control apparatus of the invention.

The outer or second end of the control shaft 16 can be formed with a flat side at 20 and the flat sided end section of the shaft extends into a hole formed in the knob of the same cross-sectional shape. Thus, the knob is non-rotatably connected to the end of the shaft and rotates with same. The shaft 16 is rotatably mounted in an upper bearing 22 and a lower bearing 24. Extending between these two bearings is a spacer sleeve 26. The upper bearing 22 is mounted in a front wall 27 of a control housing 28. The lower bearing 24 can be mounted in internal support wall 30 of the housing, this wall also forming a back for the housing so that the major components of the control apparatus are enclosed. Extending between the front wall 27 and the wall 30 are sidewalls including sidewalls 32 and 34. The wall 30 can be secured to the sidewalls by means of integral, downwardly extending flanges 34. The control housing itself can be connected to an external wall of the oven, such as front wall 36, by means of outwardly projecting connecting flanges 38 and 40. The control apparatus 12 includes a timer 42, the front of which can be located in and aligned with the front wall 27 of the housing. This timer, which per se can be of standard construction and operated electrically, can be preset to a selected time at which the control knob 14 is to be turned from the "OFF" position to the "ON" position. The timer is preferably of the type having a dial 44 (see FIG. 1) which can be set to a particular time of day, for example, 9:00 a.m. at which the control knob will be turned to the "ON" position. It is also possible to use a timer which is designed simply to rotate the control knob to the "ON" position after a certain time has elapsed, for example, eight hours. Both types of timers are within the scope of the present invention. The illustrated timer 42 is mounted on the wall 30 by means of a plurality of machine screws 46 secured in place by nuts 48. Although only two machine screws 46 are shown in FIG. 2, there can, for example, be four of these screws, one screw being located at each corner of the timer housing. In order to properly position the timer in the housing, spacer sleeves 50 can extend around the screws and extend between the wall 30 and the back of the timer.

Another component of the control apparatus is an actuator motor 52 and this motor can also be of standard construction for a small, electric motor. This motor is capable of turning the control knob 14 via the shaft 16 to the "ON" position with the operation of the motor being controlled by the timer 42. Thus, the motor is turned on by the timer at the selected time during use of the control apparatus. As usual, the motor 52 is provided with a rotatable output shaft 54 indicated in dashed lines in FIG. 2. It will be appreciated that the motor 52 can be rigidly mounted in the control housing in a variety of ways. The mounting mechanism for the motor mounts the motor at a suitable location for turning the control knob 14 via the shaft 16. As illustrated, the motor is supported by means of machine screws 56, only one of which is shown for ease of illustration. These screws are connected to the wall 30 by means of nuts 58. The motor 52 is suitably located in the housing by the use of spacers 60 through which these screws 56 extend. The spacer extends between the wall 30 and a connecting flange 62 for the motor.

There is a drive mechanism or drive means for operatively connecting the output shaft of the motor to the control knob so that the control knob is turned to the "ON" position when the motor is turned on. The aforementioned control shaft 16 can be considered part of this drive mechanism or separate therefrom. The preferred drive mechanism includes a driven gear 65 which is mounted fixedly to the control shaft 16, and a drive gear 66 rotatable by rotation of the output shaft 54 of the motor and in engagement with the driven gear 65. As illustrated, the drive gear 66 is substantially smaller than the driven gear. In order to operatively connect the shaft 54 with the drive gear 66, a suitable gear arrangement or system can be provided in gear enclosure 70 located directly below the motor 52 and connected thereto. As such gear systems are well known and as a variety of such systems could be used, a detailed description herein is deemed unnecessary. The gear system should be set up to take into account the size or power of the motor 52 and a suitable speed of rotation for the knob 14 when the motor is turned on. Arranged next to the gear 65 is a thrust washer 72.

The control shaft 16 can be connected by means of a standard shaft coupling 74 to a gas valve stem 76. It will be understood that the rotation of the stem 76 operates the gas valve 18. The direction of gas flow through the valve is indicated by the arrow A but it will be understood that the gas flow could be in the opposite direction. The aforementioned valve stem 76 extends through a hole 80 formed in the front wall 36 of the oven.

Another component of the control apparatus 12 is a mechanism or means for automatically returning the control knob 14 to the "OFF" position when the motor is turned off. In the illustrated preferred embodiment, this returning mechanism is a coil spring 82 which is attached to the connecting mechanism that connects the output shaft of the motor to the control knob. As illustrated, the preferred coil spring 82 extends around the shaft 16 and it has one end 86 which is connected to the driven gear 65. The opposite end 88 of the spring can be connected to any suitable rigid support to prevent movement of this end, for example, it can be connected to a sidewall of the housing 28. Alternatively, the end 88 can simply be arranged in the housing so that it prevents rotation of the coil spring about the central axis of the shaft 16 when the driven gear 65 is turned by the motor. It will be appreciated that the spring 82 must be sufficiently strong that it is capable of returning the control knob to the "OFF" position when the motor 52 is turned off.

It will be seen that the preferred control housing 28 as illustrated is able to contain all of the major components of the control apparatus, although it does not contain the control knob 14, which can be arranged on the front thereof. Thus, the control housing contains the timer 42, the actuator motor 52, the gear system for connecting the output shaft of the motor to the control knob, and the spring mechanism for automatically returning the control knob to the "OFF" position.

Figure 3:
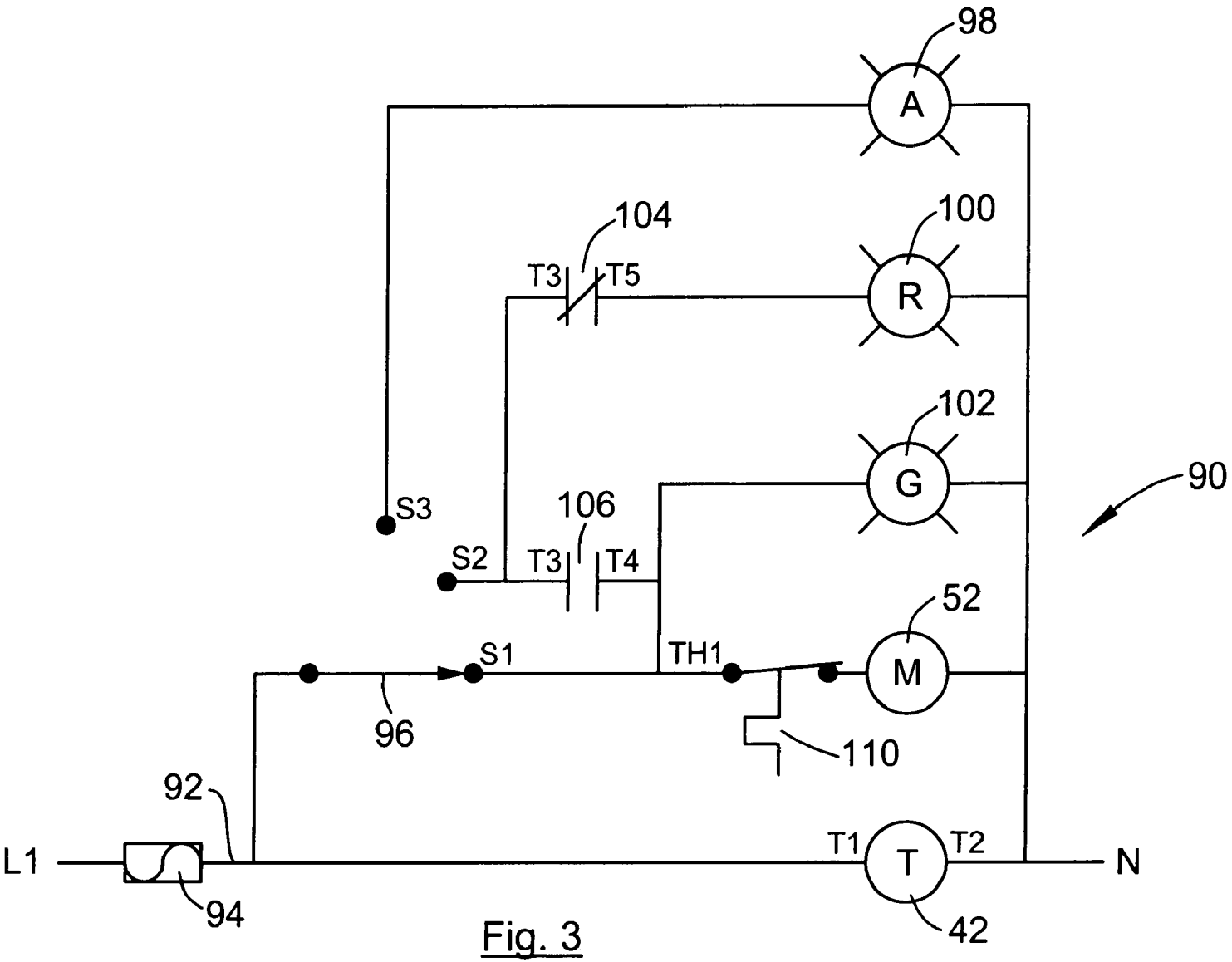
FIG. 3 is a circuit diagram illustrating a preferred electrical circuit for the control apparatus.

Turning now to FIG. 3 of the drawings which illustrates a preferred form of electrical control circuit 90, the control circuit is operatively connected to the timer 42 and the actuator motor 52. The circuit is provided with electrical power through the usual power line 92 which can be protected by a standard fuse 94. The control circuit includes an electrical switch 96 which preferably is a three position switch as shown. The switch 96 can be used to manually control operation of the control circuit 90. The three positions of the switch are indicated at S1, S2 and S3. In the first position S1 of the switch, the motor 52 is provided with power from the main power line and turns the control knob 14 to the "ON" position. The second position S2 is used when the timer is used or has been used to preset the selected time for turning on the oven. The third position S3 is used when the motor is turned off.

The preferred illustrated circuit also includes indicator lights 98, 100 and 102 which preferably are of different colours. For example, the light 98 can be amber, the light 100 can be red when lit, and the light 102 can be green. Located between the contact point S2 of the switch and each of the indicator lights 100 and 102 are contact timers 104 and 106 respectively. The lights indicate the current operational status of the control apparatus during use thereof. It will also be seen that the lights 98, 100 and 102 correspond respectively to the three positions of the switch 96. Although not shown in FIGS. 1 and 2, the indicator lights can be mounted either on the control housing 28 where they will be visible or possibly on the front of the oven or appliance itself. The amber light is simply to indicate that electrical power is available to the oven but the oven is turned off and the timer has not been set. The green light indicates the power is being provided to the motor 52 and, as a result, the oven is turned on.

The timer 42 is set when the switch 96 is moved from position S3 to S2, at which time the red lamp 100 is turned on. When the timer has ticked down to the required time for turning on the oven, power is then provided by closure of the contacts at 106, this closure causing the green lamp 102 to come on. The position S1 of the switch is simply the manual "ON" position for the oven which can be turned on manually by simply turning the control knob 14 to this position.

An illustrated preferred feature of the control circuit 90 is a high limit thermostat 110 that is located in the circuit between switch contact S1 and the motor 52. This is a safety feature designed to shut off the oven if it reaches a certain, predetermined maximum temperature.

Another preferred feature illustrated in FIG. 2 is a manual interlock or locking device 125. This can be mounted on the front wall 27 adjacent to the control knob 14 by means of screw 126. The interlock 125 can be moved manually into or out of a suitably sized cavity or recess 128 formed in one side of the knob 14. The interlock can be used to manually set the knob 14 is the "ON" position when required. Thus, with this device, the control knob can be held in the "ON" position even though the motor 52 is not operating. It will be understood that the mounting screw 126 is slidable back and forth in a slot formed in the wall 27 (but not shown).

It will be understood that the control knob 14 and the control shaft 16 can be formed as an integral, one-piece part, if desired, rather than two separate parts. Also, these two parts can together be considered a manually rotatable control device and the actuator motor 52 serves the purpose of rotating this control device from an "OFF" position to a "ON" position. Furthermore, although the illustrated preferred embodiment uses a gear system to connect the output of the motor to the control shaft 16, it will be appreciated by those skilled in the art that it is also possible to construct a control apparatus wherein the motor 52 is connected by a suitable drive unit to the knob 14 itself, rather than the shaft 16.

It will also be appreciated that the manual switch 96 can be replaced by an electrically operated digital switch, if desired. Such digital switches are well known for electronic and electrical controls and therefore a detailed description herein is deemed unnecessary.

It will be appreciated by those skilled in the art of controls for equipment and appliances that various modifications and changes can be made to the above described control apparatus without departing from the spirit and scope of this invention. Accordingly, all such modifications and changes as fall within the scope of the appended claims are to be considered as within the scope of this invention.

I claim:

1. A control apparatus for a device having a control knob rotatable between an "OFF" and an "ON" position, said control apparatus comprising:

a timer that can be preset to a selected time at which said control knob is to be turned from said "OFF" position to the "ON" position;

an actuator motor for turning said control knob to the "ON" position, the operation of said motor being controlled by said timer whereby said motor is turned on by said timer at said selected time during use of said control apparatus, said motor having a rotatable output shaft;

means for mounting said motor at a suitable location for turning said control knob;

drive means for operatively connecting said output shaft of said motor to said control knob so that the control knob is turned to the "ON" position when said motor is turned on; and means for automatically returning said control knob to the "OFF" position when said motor is turned off.

2. A control apparatus according to claim 1 wherein said means for automatically returning said control knob is a spring attached to said drive means.

3. A control apparatus according to claim 2 wherein said drive means includes a rotatable control shaft on which said control knob is mounted during use of the control apparatus, a driven gear fixedly mounted on said control shaft, and a drive gear rotatable by rotation of said output shaft of said motor and in engagement with said driven gear.

4. A control apparatus according to claim 3 wherein said spring is a coil spring that is coiled around said control shaft and one end of said coil spring is attached to said driven gear.

5. A control apparatus according to claim 1 further including a control housing adapted to contain said timer, said actuator motor, said drive means, and said means for automatically returning said control knob to the "OFF" position.

6. A control apparatus according to claim 1 including an electrical control circuit operatively connected to said timer and said actuator motor, said control circuit including an electrical switch for manually controlling operation of said control circuit.

7. A control apparatus according to claim 6 wherein said switch is a three position switch movable from a first position, where said motor is normally turned on, to a second position used when said timer is preset to the selected time, and to a third position where the motor is turned off.

8. A control apparatus according to claim 7 wherein said control circuit includes indicator lights capable of indicating a current operational status of the control apparatus during use thereof, said indicator lights including lights corresponding respectively to the three positions of said switch.

9. A combination timer and controller for a gas operated appliance, said combination comprising:

a rotatable control shaft having a first end connectible to a gas valve of said appliance in order to operate same;

a control knob attachable to a second end of said control shaft located opposite said first end;

a timer that can be preset to a selected time at which said control shaft is to be turned from a first position corresponding to an "OFF" position of said control knob during use thereof to a second position corresponding to an "ON" position of said control knob during use thereof;

an actuator motor for turning said control shaft to said second position, the operation of the motor being controlled by said timer so that said motor is turned on by said timer at said selected time when said timer is used;

means for mounting said motor at a suitable location for turning said control shaft;

drive means for operatively connecting said motor to said control shaft so that said motor is capable of rotating said control shaft to said second position; and means for rotating the control shaft to said first position and said control knob to the "OFF" position when said motor is turned off.

10. A combination according to claim 9 wherein said rotating means comprises a coil spring, said drive means includes a driven gear fixedly mounted on said control shaft, and one end of said coil spring is attached to said driven gear.

11. A combination according to claim 9 including a manually operated locking device capable of locking said control knob in said "ON" position and movable from a locking position to an unlocked position.

12. A combination according to claim 9 including a control housing containing said timer, said actuator motor, said drive means, and said rotating means.

13. A combination according to claim 12 wherein said control housing includes means for mounting the control housing on said appliance in the vicinity of said gas valve.

14. A combination according to claim 9 wherein said drive means includes a driven gear fixedly mounted on said control shaft and a drive gear rotatable by said motor during use of said combination and operatively enaging said driven gear.

15. A combination according to claim 9 including an electrical control circuit operatively connected to said timer and said actuator motor, said control circuit including an electrical switch for manually controlling operation of said control circuit.

16. A combination according to claim 15 wherein said switch is a three position switch movable from a first position, where said motor is normally turned on, to a second position used when said timer is preset to the selected time, and to a third position where the motor is turned off.

17. A combination according to claim 16 wherein said control circuit includes several indicating lights capable of indicating a current operational status of the combination, during use thereof, said indicator lights including lights corresponding respectively to the three positions of said switch.

18. A combination timer and controller for operating a valve of an appliance, said combination comprising:

a manually rotatable control device including a control knob and a control shaft connected to said knob, said control shaft being connectible to said valve for operation of the latter;

a timer for timing the operation of said valve;

an electric actuator motor for rotating said control device from an "OFF" position to an "ON" position, said motor in use being controlled by said timer, which is operatively connected thereto, and being turned on by said timer at a selected time during use of said combination;

means for mounting said motor in a suitable position for operation;

means for operatively connecting said motor to said control device so that said control device is rotated to said "ON" position when motor is turned on and operates; and a spring mechanism for returning said control device to the "OFF" position when said motor is turned off.

19. A combination according to claim 18 wherein said connecting means includes a driven gear fixedly mounted on said control device and a drive gear rotatable by said motor and said spring mechanism includes a coil spring having one end connected to said driven gear.

20. A combination according to claim 19 including an electrical control circuit operatively connected to said timer and said actuator motor, said electrical circuit including an electrical switch for manually controlling operation of said control circuit.

* * * * *